US005264901A

United States Patent [19]

Rossiter

[11] Patent Number: 5,264,901

[45] Date of Patent: Nov. 23, 1993

[54] TONER CARTRIDGE SEAL

[75] Inventor: Dennis E. Rossiter, Las Vegas, Nev.

[73] Assignee: Future Communications Corporation, Las Vegas, Nev.

[21] Appl. No.: 997,691

[22] Filed: Dec. 28, 1992

[51] Int. Cl.[5] ..... G03G 15/06

[52] U.S. Cl. ..... 355/260; 222/DIG. 1

[58] Field of Search ..... 355/245, 246, 260; 118/653; 222/DIG. 1, 236, 238, 541; 156/344, 247, 584; 242/55.3, 71.1, 71.7

[56] References Cited

U.S. PATENT DOCUMENTS

| | | | |
|---|---|---|---|
| 4,502,514 | 3/1985 | Ballard et al. | 206/624 X |
| 4,799,608 | 1/1989 | Oka | 222/505 |
| 4,862,210 | 8/1989 | Woolley | 355/245 |
| 4,895,104 | 1/1990 | Yoshino et al. | 118/653 |
| 4,969,557 | 11/1990 | Oka | 206/527 |
| 4,998,140 | 3/1991 | Satou et al. | 355/245 |
| 5,027,156 | 6/1991 | Kobayashi | 355/245 |
| 5,030,998 | 7/1991 | Shibata et al. | 355/260 |
| 5,075,727 | 12/1991 | Nakatomi | 355/260 |
| 5,079,589 | 1/1992 | Shibata et al. | 355/245 |
| 5,080,745 | 1/1992 | Paull | 156/247 |
| 5,110,646 | 5/1992 | Prestel et al. | 355/260 |
| 5,139,176 | 8/1992 | Reindl et al. | 355/260 X |

FOREIGN PATENT DOCUMENTS

| | | | |
|---|---|---|---|
| 4-110877 | 4/1992 | Japan | 355/260 |

*Primary Examiner*—A. T. Grimley
*Assistant Examiner*—Shuk Y. Lee
*Attorney, Agent, or Firm*—Edward J. Quirk

[57] ABSTRACT

A sealing method is provided for preventing leakage of toner from the initial fill or refill of a toner cartridge, in particular an IBM 4019/4029 cartridge used for a laser printer. The sealing method includes a tape, partially coated with adhesive, which extends substantially along the entire length of a slot formed by a pair of flexible guide members at the bottom of the toner hopper. Preferably, the tape has adhesive edge portions which attach to the guide members and a non-adhesive central portion which extends over the length of the slot. At least one end, and preferably both ends, of the tape extend from the ends of the slot and attach adhesively to one or more arms of a stirring member which is rotatably mounted in the hopper. Pairs of transverse slits which extend through the adhesive portion of the tape at a location between the ends of the slot and the ends of the tape enable the non-adhesive central portion of the tape to peel away from the adhesive portions upon rotation of the stirrer. Upon initial use of the cartridge after filling the cartridge with toner, rotation of the stirrer peels the central portion of the tape away from the slot, allowing toner to fall through the slot to a feeder bar mounted below.

19 Claims, 4 Drawing Sheets

TONER CARTRIDGE SEAL

FIELD OF THE INVENTION

This invention relates to a seal for, and a method of sealing, a toner cartridge or bin, and particularly relates to a method of refurbishing certain IBM laser printer toner bins and resealing the refurbished bins to allow their reuse.

BACKGROUND OF THE INVENTION

Laser printers and certain photocopiers employ cartridges that contain a supply of xerographic toner powder. These cartridges must be replaced from time to time as the toner is exhausted. Toner cartridges are relatively complex pieces of equipment, which include a hopper for holding the toner, a stirring mechanism to ensure that the toner is freely and uniformly distributed within the bin, feeding and metering devices for distributing toner in required amounts from the bin, and various equipment for transferring toner to a magnetic roller assembly.

The toner material is a fine, black powder which must be sealed within the hopper portion of the toner cartridge in order to prevent leakage during shipment, storage, and installation. Because most toner bins have an elongate slot at a lower portion thereof through which toner is metered during the use of the cartridge, manufacturers of cartridges generally insert container seals in place during the manufacturing process prior to filling the hoppers with toner. The manufacturer's seals may vary depending on the particular configuration of the cartridge; however, the seals generally comprise a barrier placed along the slot which can be removed by sliding away from the slot before the cartridge is inserted in the xerographic device.

Printer and copier cartridges are designed by the manufacturer to be discarded and replaced after the toner supply is used up. Because toner cartridges are relatively complex, expensive devices which actually have a useful life far in excess of the initial supply of toner, efforts have been made to refurbish and reuse cartridges for various copying and printing devices. A problem that is inevitably encountered in the refurbishing of these cartridges is the resealing of the exit port or slot of the hopper. Refurbishers of cartridges have devised various methods of providing a barrier or seal for the slots, generally mimicking a replacement for the original seal installed by the manufacturer. For example, Paull, U.S. Pat. No. 5,080,745, discloses a method of inserting an adhesive sheet into the slot opening of certain Canon cartridges.

To date, however, no satisfactory sealing technique has been developed for enabling reuse of cartridges for IBM laser printers, particularly IBM Toner Cartridge Model Numbers 4019 and 4029. The seal and method of the invention provide a suitable method for sealing the bin of an IBM laser printer cartridge hopper enabling refilling and reuse of the cartridge. While the seal of the invention is particularly useful for enabling reuse of the original cartridge, the seal provides a highly effective method of preventing leakage of toner and can be used for the original design of the hopper. In addition, the seal of the invention may be used on any toner hopper having an elongate discharge slot and an internal rotating mechanism such as a stirrer.

Accordingly, it is an object of the invention to provide a method of sealing a toner bin cartridge enabling refill and reuse of the cartridge. It is another object of the invention to provide an adhesive seal applied to the internal portion of the discharge slot of the toner bin, with removal of the seal occurring automatically upon initiation of use of the cartridge, with removal being affected by the existing moving parts of the cartridge. These and other objects of the invention are accomplished by means of the particular seal of the invention, a specific embodiment of which is described herein.

SUMMARY OF THE INVENTION

The IBM laser printer cartridge hopper includes a rotating stirrer mounted lengthwise in a central portion of the hopper, and also includes an elongate toner discharge slot at a lower portion of the hopper which is formed by a pair of opposed flexible guide members. The toner discharge slot is located directly above a rotating feeder bar which meters toner falling through the slot to the magnetic roller.

In accordance with the invention, the slot is sealed prior to filling the bin with toner by a length of adhesive tape having an non-adhesive central portion. The tape is applied along both edges of the guide members, traversing the entire length of the slot. The non-adhesive central portion of the tape extends over the slot, with the adhesive edges of the tape attaching to opposing edges of the guide members. The tape extends along the slot, past an end of the slot to the cartridge wall, and from the cartridge wall to a blade member of the rotating stirrer. A portion of the tape between the slot and the stirrer adheres to the interior cartridge wall, and at least one end portion of the tape connects to the stirrer blade. A pair of transverse slits are made in the adhesive portion of the tape between the end of the slot and the portion of the tape that adheres to the cartridge wall, enabling the central portion of the tape to be pulled away on rotation of the stirrer, exposing the slot.

When the cartridge is in place in the laser printer, upon initial use of the cartridge the tape is automatically removed by rotation of the stirrer. Upon actuation of the stirrer, rotation of the stirrer blades having the tape attached thereto pulls the tape away from the wall and wraps the tape around the body of the stirrer. The central non-adhesive portion of the strip peels away from the slot, exposing the slot and permitting toner to fall through onto the feeder bar. The outer edges of the tape remain adhered to the guide members, but do not interfere with future operation of the cartridge.

BRIEF DESCRIPTION OF THE DRAWINGS

The invention is best understood with reference to the drawings, in which.

DETAILED DESCRIPTION OF THE PREFERRED EMBODIMENT

Figure 1:
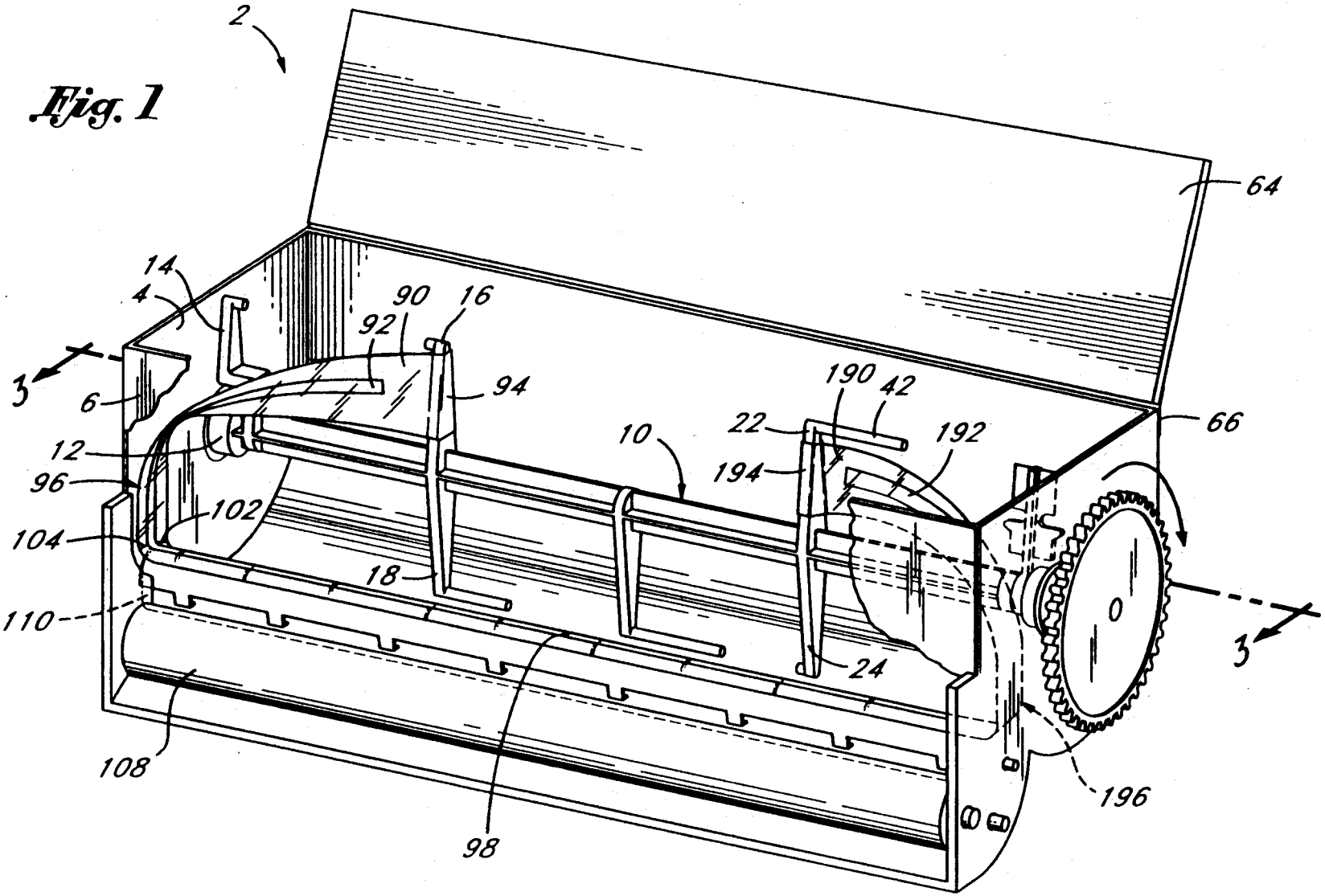
FIG. 1 is a perspective view of the interior of the hopper portion of a toner cartridge showing the seal of the invention in place.

Referring first to FIG. 1, toner cartridge 2 is IBM Model 4019/4029 cartridge which is manufactured for the IBM Model 4019/EO1 Laser Printer. The cartridge has been refurbished providing a seal in accordance with the invention. The toner bin or hopper portion of the cartridge comprises end wall 4, front wall 6, and rear wall 8. A molded plastic mixer or stirrer 10 is centrally mounted in the hopper; a shaft of the stirrer 10 is mounted in bearing mount 12 attached to the end wall 4 of the hopper. The stirrer is driven in the direction shown by the arrow through gears shown in FIG. 2.

Figure 2:
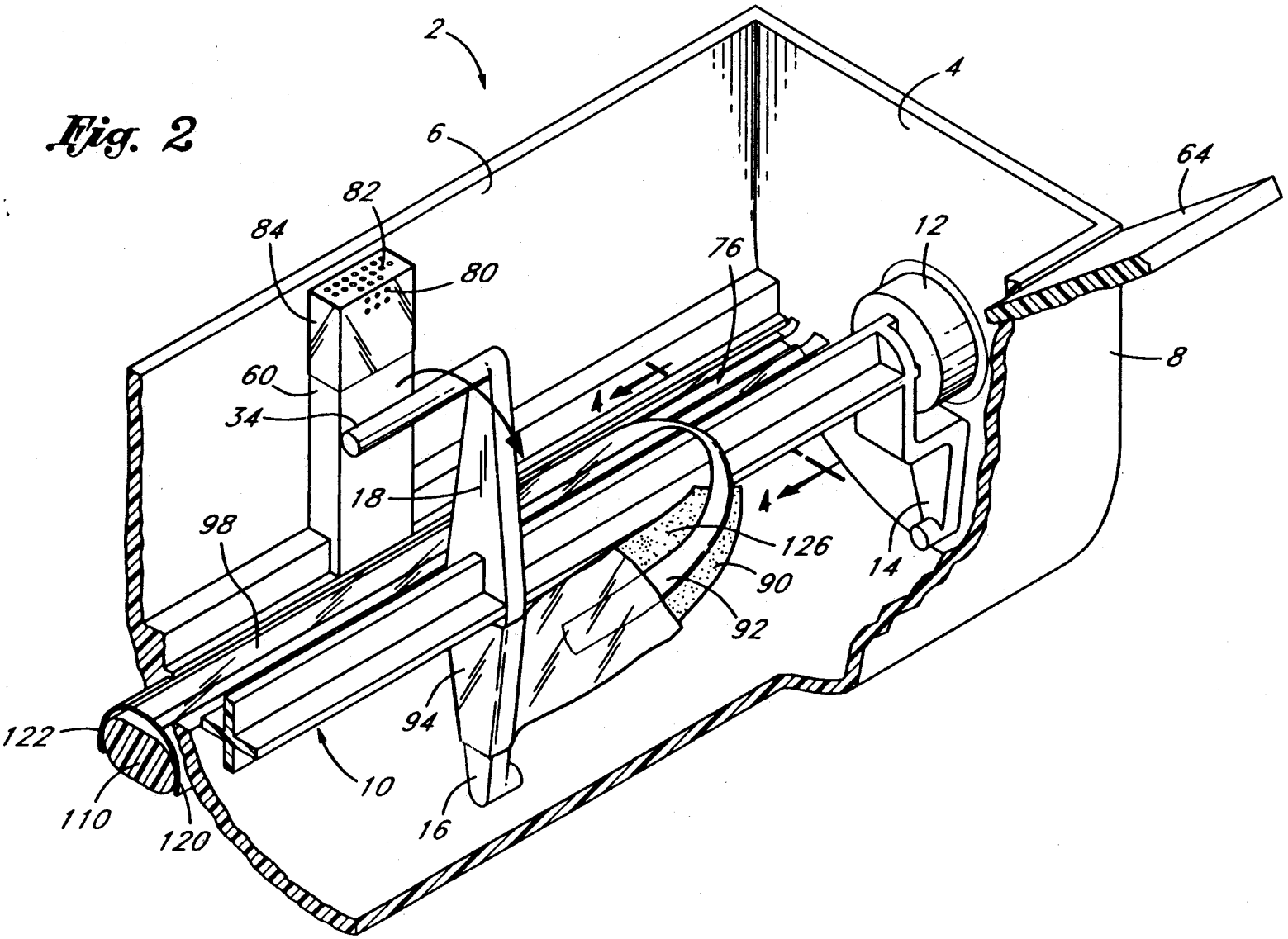
FIG. 2 is a partial view of the toner cartridge hopper showing the seal being removed.

The stirring device 10 is better shown in FIG. 2 and generally consists of a central shaft comprising four radial ribs 61/62 extending outwardly at 90 degree intervals around the shaft. As constructed by the manufacturer, mixing of toner in the hopper is effected by a plurality of stirrer members consisting of a series of radial arms having stirring bar members extending between the arms. Radial arms 13, 16, 18, 20, 22, 24 and 28 extend outwardly from the shaft as shown in FIG. 2. The stirring blades or bars as originally produced by the manufacturer are molded dowel members, portions of which have been removed in accordance with the invention to enable the sealing tape to better wrap around the stirrer as it is removed. The removed portions of the stirring bar members are shown in phantom by means of dotted lines in FIG. 2.

For example, substantially all of the bar member extending between arms 14 and 16 has been removed, leaving stubs 30 and 32. This enables easy attachment of the end 94 of the sealing tape to arm 16. Similarly, approximately one-half of bars 34 and 38 have been cut away, leaving stubs 36 and 40 attached to arms 20 and 24, respectively. A measured portion of stirring bar 42 has also been removed. The removed portions of the stirrer are shown in phantom in FIG. 3 as sections 44, 152, 154, and 150. It has been found that removal of portions of the stirring blades does not affect the effectiveness of the stirrer in distributing toner in the hopper properly along the bin. Removal of portions of the blades enables the tape to wrap around the shaft in a random manner as shown in FIG. 2 upon initial actuation of the stirrer after replacement of the refurbished cartridge into a printer.

It is preferred that the tape, upon removal, wrap around the central shaft 26 of the stirrer rather than the outward blades, thus ensuring that the tape will not interfere with the flow of toner through the discharge slot. Removal of portions of the stirring blades accomplishes this purpose. A rubber sweeper 46 has been installed by the manufacturer to sweep toner from an end portion of the bottom of the hopper behind a molded lug (not shown). The lug exists simply to enable fit of the cartridge into the printer and appears to have no other function; the sweeper does not form a part of the invention and has not been modified in any way in implementing the sealing techniques of the invention. The sweeper is simply mounted on radial arm 28 by slipping it over a tab member 48.

The stirring device is mounted in the end wall 51 of the hopper through a shaft 54 extending through the wall and through bearing 56. Gear 52 is mounted at the end of the shaft and serves to drive the stirring device through other drive gears (not shown).

Figure 3:
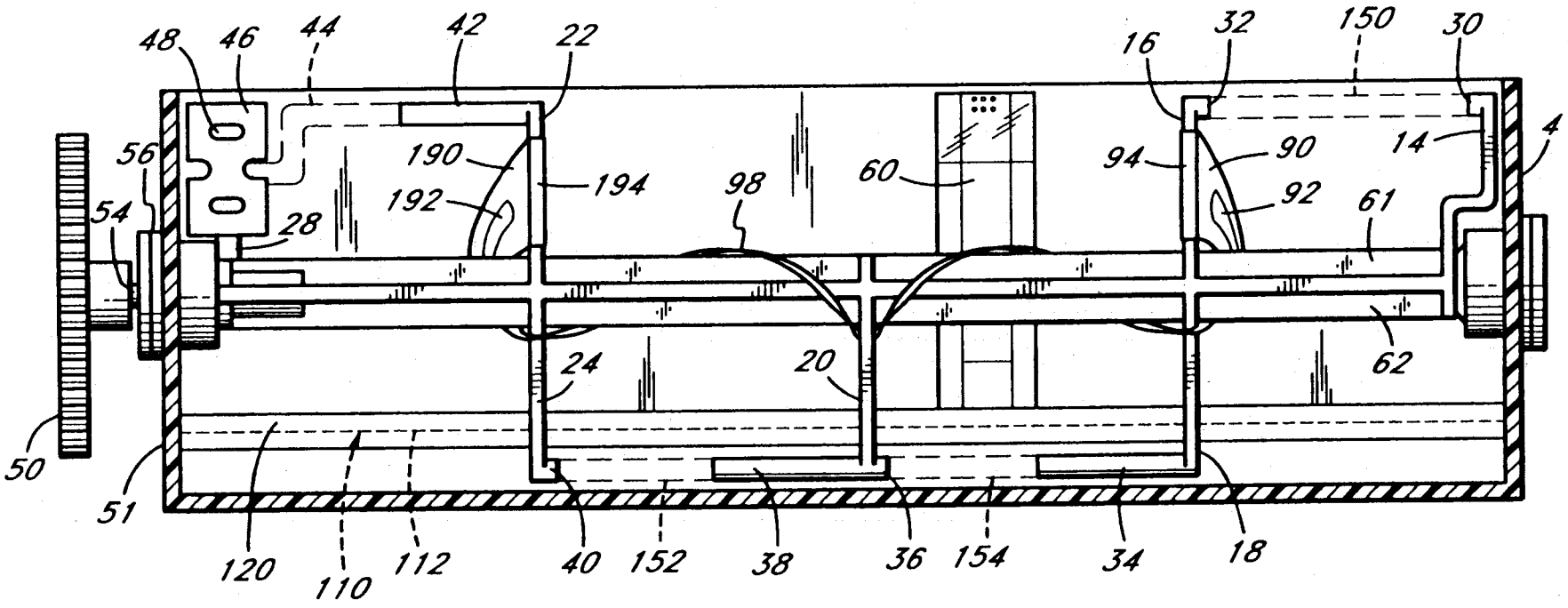
FIG. 3 is a side section view (taken at 3—3) of the hopper showing the seal removed.

The discharge system for the toner bin, as well as the sealing method of the invention, are best seen in FIG. 3. A pair of opposed flexible plastic feeder bar flaps or guides 120 and 122 are mounted in an opening near the bottom of the toner bin. The upper edges 72 and 78 of the flaps form a slot 76 through which toner falls onto a feeder bar 110 which extends substantially along the entire length of the slot. The slot is approximately 9 ¼" long and 3/32" wide. The feeder bar 110 has a truncated circular cross-section, having round side portions 116 and 118 and opposing flat upper and lower surfaces 112 and 114. As the feeder bar rotates, toner falls through the slot 76 onto the upper surface of the feeder bar. A measured portion of toner is then carried through rotation of the feeder bar between the guide flaps 120 and 122 and is dumped on a sponge-covered roller 108 located below the feeder bar. The sponge-covered roller then transfers the toner to a magnetic roller (not shown) which is also part of the cartridge assembly. The feeder bar is driven by gears linked to stirrer gear drive 50. Thus, in normal operation of the cartridge, the gear system drives the stirring device which assures a constant supply of toner at the slot. Toner falls continuously through the slot onto the flat surfaces of the rotating feeder bar which, in turn, distributes the toner to the surface of the sponge-covered roller. Excess toner falls into an excess toner bin.

As originally received from the manufacturer, the IBM cartridge does not contain any seal internally or externally. This has been found to create leakage through the slot around the feeder bar, even if the rounded portion of the feeder bar is rotated to be adjacent the feeder bar flaps.

The sealing tape 98 is a laminate of a transparent flexible tape, preferably Quill brand 7-65004, having a width of ¾". The tape has an adhesive surface and a non-adhesive back surface. Masking film 92 having a width of 3/16" is attached by pressing the film on the adhesive surface of the transparent adhesive tape along the center of the tape, i.e., approximately equidistant from the edges of the tape. The resulting product is a strip of tape having adhesive outer portions approximately 9/32" in width and a 3/16" non-adhesive strip portion down the middle. In addition, the central portion of the tape is substantially thicker and stronger than the edges because of the presence of the masking film. A suitable masking film is Ruby Lyth brand masking film or drafting vellum.

Figure 4:
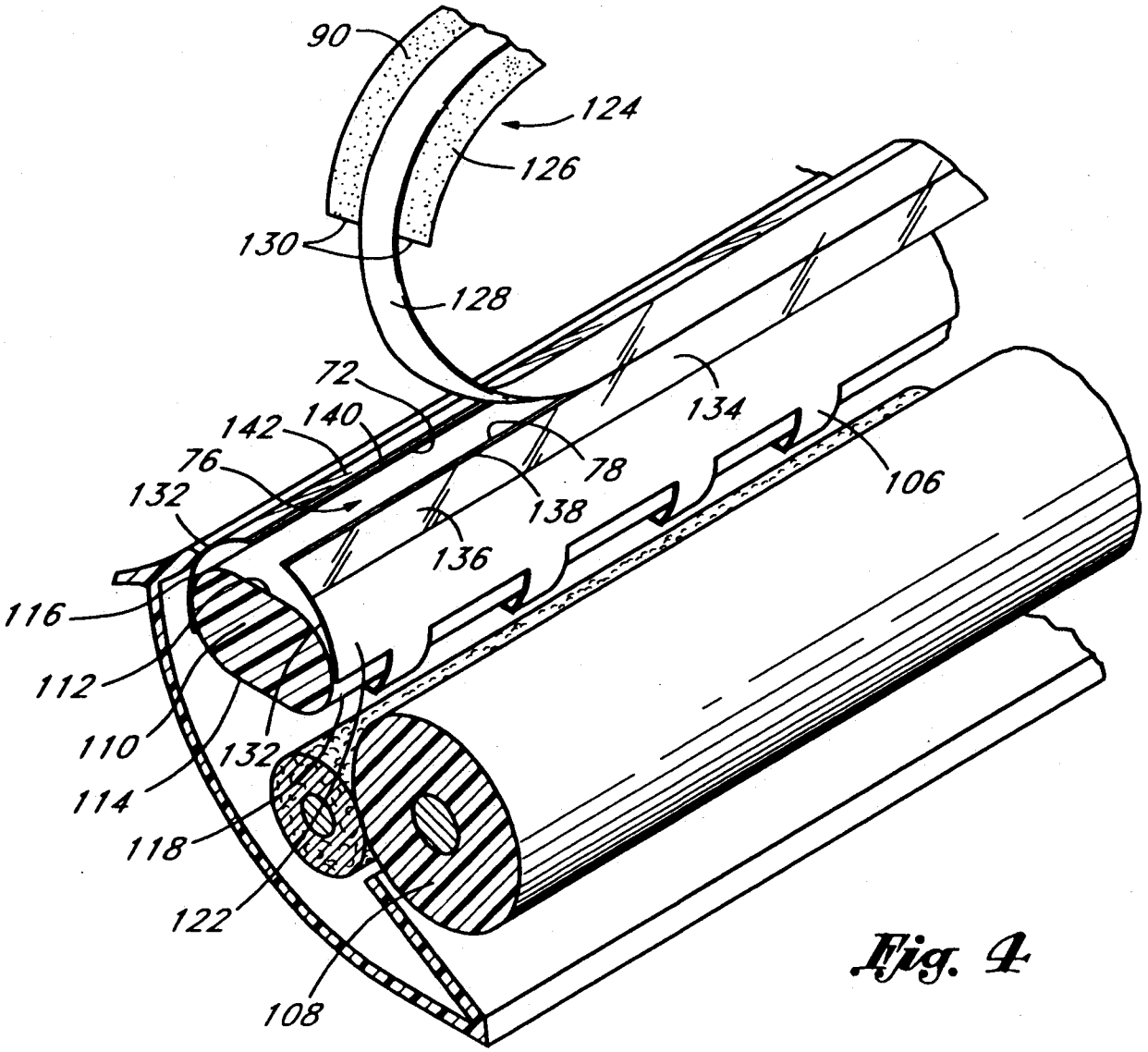
FIG. 4 is a partial section view of a portion of the hopper taken at section 4—4 showing removal of the central portion of the sealing tape.

As shown best in FIGS. 2–4, the tape after modification consists of an elongate strip having a non-adhesive central portion 92 formed by adhering the masking sheet to the tape, and adhesive edge portions 90 and 126, the central portion being of greater thickness than the edge portions of the tape. One purpose of a non-adhesive section of the central portion of the tape is to permit the masking tape to strip away the central portion while leaving the edges of the tape adhered to the flexible guide flaps. This minimizes stress on the gears and roller during removal of the adhesive from the guide flaps, and eliminates possible jamming of the mechanism due to the inability of the roller to completely strip the adhesive tape from the slot. The non-adhesive section of the tape also permits the sealing tape to be pressed downwardly against the feeder bar without sticking the tape to the bar during application of the seal.

Prior to applying the sealing tape to the slot, small portions of transparent adhesive tape (not shown) are attached at the ends of the slot across the guide flaps simply to ensure that toner does not escape at the very ends of the slot. Application of the small pieces of tape is not essential to the invention but helps to preclude the possibility of leakage of toner. In applying the sealing tape to the slot, the feeder bar is first rotated to a position in which the round surface of the feeder bar faces upwardly toward the slot; i.e., 90 degrees rotation from the orientation shown in FIG. 3.

Beginning at the end closest to the gears, tape is applied to the slot with the adhesive edges of the tape adhering to the opposing guide flaps 120 and 122 with the central non-stick portion of the sealing tape being centered over the slot 76. Because the guide flaps are flexible, the tape may be pressed into place manually, with the flaps bending downwardly and contacting the curved surface of the feeder bar ensuring firm adhesion of the tape to the flaps. Application of the tape then continues over the entirety of the slot past the edges 132 of the flaps and up adjacent the end wall 4 of the toner bin. The tape is attached to the wall simply by pressing the adhesive portions to the wall approximately one inch above the bottom edge of the wall. The tape is then extended backwardly in the hopper and wrapped around radial stirrer arm 16. After wrapping around the arm, the tape is then terminated by attaching the end of the tape back onto itself to ensure that the tape will not come loose from the stirrer.

In a preferred embodiment of the invention, both ends of the sealing tape are attached to the stirring mechanism 10 as shown in FIGS. 1 and 3. As best seen in FIG. 1, tape 98 extends along the entire length of the toner discharge slot. One end portion of the tape extends from the end of the slot and attaches to the inside surface of cartridge wall 4 at 96. The tape continues inwardly, attaching to radial stirrer arm 16 at 94. The opposite end of the tape similarly attaches to the interior of wall 51 at 196, then extends inwardly and adhesively attaches to stirrer arm 22 by wrapping around the arm at 194. If desired, only one end of the tape may be attached to the stirrer. However, attaching both ends to the stirrer precludes the loose end of the tape from remaining unattached in the hopper and results in less pulling force on the flexible guide members since the tape is being removed from both ends.

Immediately below the section of the sealing tape which is adhered to end wall 4 at 96 (see FIG. 1), a pair of transverse slits 102 and 104 are manually cut into the adhesive portion only of the tape. These slits are located in the portion of the tape between the end of the slot and the attachment point 100 on the wall. The other end portion of the tape also attached to wall 51 at 196, and a similar par of transverse slits (not shown) are cut in the adhesive edge portions of the tape.

The tape is automatically removed from the slot by the first actuation of the stirring device, which occurs as soon as the laser printer is used after the refurbished toner cartridge is placed in the printer. As the stirring device rotates, the tape is pulled rotationally around the shaft 26 and is stripped away from the wall 4. As rotation of the stirring device continues, when the tape begins to be pulled at the slits 102 and 104, the center portion of the tape, which includes the masking film and which is considerably stronger than the adhesive backing, pulls away from the adhesive portion of the sealing tape as shown in FIG. 3. The masked portion 128 of sealing tape 124 pulls away from the adhesive portion at edges 130, which correspond to the slits 102 and 104. As the center portion of the tape is peeled away from the slot, the outer edges 136 and 142 of the sealing tape remain attached to guide flaps 120 and 122, respectively. If properly applied, the width of the masked portion of the sealing tape is very slightly wider than the slot 76, leaving some very small strips 138 and 140 along the edges 72 and 78 of the slot on which no adhesive tape remains. As the central portion of the tape is peeled away as shown in FIG. 3 exposing the toner discharge slot, rotation of the stirrer continues to wrap the removed portion of the tape around the stirrer in a generally random fashion as shown in FIG. 2. The tape is stripped away within the first two revolutions of the stirring device.

The sealing tape is generally prefabricated by cutting a piece of the Quill adhesive tape 13-3/16" long and taking a piece of the masking film 11"×3/16" and attaching it to the adhesive side of the adhesive tape. The masking film is attached ¼" from one end of the adhesive tape. While various brands of masking tape and adhesive tape can be used, it is important simply that the combination of tapes used enables the masked portion of the tape to peel away from the edges of the tape in the manner shown in FIG. 3. To this end, the adhesive tape should be relatively thin and easy to cut, thereby enabling the masking portion of the tape to slice through the adhesive tape to make parallel lengthwise cuts in the base tape as shown in FIG. 3. This result can easily be obtained by trial and error using various types of tapes, although the specific Quill tape and masking tape identified herein are highly suitable for this purpose.

Several other modifications can be made during the refurbishing of the cartridge which are also beneficial. For example, it has been found that leakage of toner can be virtually completely shut off if, in addition to sealing the slot as described herein, the holes 80 and 82 in the side and top of breather tube 60 are closed with tape. The breather tube is installed by the manufacturer in the front interior portion of the bin and permits air to pass through the holes to the outside of the bin. In a preferred aspect of the invention, tape 84 is placed over the breather tube holes simply to keep toner from falling through the holes.

In addition, a new rigid or semi-rigid cover 64 is placed over the open top of the toner bin. The cover is generally coextensive with the top of the bin and is taped with packaging tape along the rear upper edge of the bin, with the tape forming a hinge allowing the cover to open and close over the top of the bin. After the bin is refilled with toner, the cover is shut and completely sealed around its edges with packaging tape, thereby precluding any leakage of toner through the top of the bin during transportation, storage or use.

While the refurbishing and sealing method of the invention have been specifically designed for IBM 4019/4029 toner cartridges, the sealing method could, in principle, apply to any toner cartridges which have an internal toner discharge slot and an interior rotating shaft, each of which is located inside the hopper. In addition, other modifications and additions to the seal of the invention will be clear to those skilled in the art. Accordingly, the invention should not be considered limited by the foregoing description of the preferred embodiment thereof, but rather should be defined only by the following claims.

I claim:

1. In a toner cartridge for a xerographic device having a hopper for toner, a rotating stirring mechanism within the hopper to stir toner contained in the hopper, an elongate toner discharge slot at a lower portion of the hopper formed by a pair of guide members which extend inwardly into the hopper, the improvement which comprises sealing means for precluding leakage of toner through the slot prior to initial use of the cartridge after filling the hopper with toner comprising:

an elongate sealing member adhesively attached to the guide members extending over the discharge slot and covering said slot to preclude passage of toner from the hopper through the slot, a portion of the sealing member being connected to the rotating stirring mechanism such that rotation of the stirring mechanism pulls at least a portion of the sealing member away from the slot, thereby allowing toner in the hopper to discharge through the slot.

2. In the toner cartridge of claim 1, said cartridge also comprising a toner metering bar rotatably mounted below the guide members such that toner exiting the hopper through the slot falls onto the metering bar.

3. In the toner cartridge of claim 2, the metering bar having a cross-section having two opposed similar curved edges and two opposed flat edges.

4. The improvement of claim 1 wherein the sealing member comprises an elongate flexible strip having a non-adhesive back surface, and a front surface having a first adhesive portion extending adjacent a first elongate edge of the strip, a second adhesive portion extending adjacent a second elongate edge of the strip, and a non-adhesive portion disposed between the first and second adhesive portions.

5. The improvement of claim 4 wherein the non-adhesive portion of the strip extends over the discharge slot.

6. The improvement of claim 4 in which the non-adhesive portion of the front surface comprises a length of flexible sheet material adhesively attached to a central portion of the strip.

7. The improvement of claim 1 wherein the sealing member has a first end portion connected to the rotating stirring mechanism, and a second end portion also connected to the rotating stirring mechanism.

8. The improvement of claim 7 wherein the sealing member extends from the rotating stirring mechanism to the discharge slot, along an entire length of the discharge slot, and back to the rotating stirring mechanism.

9. The improvement of claim 8, wherein the sealing member is adhesively attached to an interior hopper wall intermediate the slot and the rotating stirring mechanism.

10. In the toner cartridge of claim 1, the rotating stirring mechanism comprising a rotating shaft having a plurality of radial arms, and the improvement also comprising an end portion of the sealing member being adhesively attached to a radial arm.

11. In the toner cartridge of claim 1, wherein the rotating stirring mechanism comprises a plurality of radial arms, and the improvement also comprises a first end portion of the sealing member being adhesively attached to a first radial arm, and a second end portion of the sealing member being adhesively attached to a second radial arm.

12. The improvement of claim 1 also comprising a sealing member having adhesive means disposed adjacent opposed lengthwise edge portions of the sealing member, said sealing member having a central non-adhesive section having a thickness greater than the edge portions of the sealing member, the sealing member being adhesively attached to the guide members with the non-adhesive portion of the sealing member extending over the slot, such that rotation of the stirring mechanism removes the non-adhesive section of the sealing member from the slot, leaving the edge portions of the sealing member adhesively attached to the guide members.

13. A method of sealing a discharge slot of a toner cartridge having a hopper for toner, a rotating stirring mechanism within the hopper, and an elongate toner discharge slot positioned above a rotating toner metering bar, said slot being formed by a pair of opposing guide members extending inwardly into the hopper, said method comprising the steps of:

(a) applying a segment of sealing tape along the slot such that opposing edge portions of the tape are adhesively attached to the opposing guide members and an elongate central portion of the tape extends over the slot, (b) attaching an end portion of the tape to the stirring mechanism, such that upon initial actuation of the toner cartridge following filling the hopper with toner, rotation of the stirring mechanism automatically removes sealing tape from the slot, allowing toner to discharge from the hopper through the slot to the metering bar.

14. The method of claim 13 wherein the tape comprises elongate adhesive edge portions and an elongate non-adhesive central portion disposed between the adhesive edge portions.

15. The method of claim 13 which also comprises attaching a second end portion of the tape to the stirring mechanism.

16. The method of claim 15 which also comprises attaching the end portions of the tape to different radial arm segments of the rotating stirring mechanism.

17. The method of claim 13 also comprising cutting at least one transverse slit into an edge portion of the tape at a location between an end of the slot and an end portion of the tape.

18. The method of claim 13 also comprising cutting a plurality of opposed slits into adhesive portions of the tape at a location between an end of the slot and an end portion of the tape.

19. The method of claim 13 also comprising forming the segment of sealing tape by attaching an elongate portion of flexible non-adhesive sheet material to a central portion of the tape.

* * * * *